US009134640B2

(12) United States Patent
Sweeney et al.

(10) Patent No.: US 9,134,640 B2
(45) Date of Patent: Sep. 15, 2015

(54) CLEAR STYRENE EMULSION/AGGREGATION TONER

(75) Inventors: Maura Sweeney, Irondequoit, NY (US); Grazyna E. Kmiecik-Lawrynowicz, Fairport, NY (US); Robert D. Bayley, Fairport, NY (US); Dan Asarese, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/107,862

(22) Filed: May 13, 2011

(65) Prior Publication Data

US 2012/0288790 A1 Nov. 15, 2012

(51) Int. Cl.

| | |
|---|---|
| ***G03G 9/087*** | (2006.01) |
| ***G03G 9/08*** | (2006.01) |
| ***G03G 9/093*** | (2006.01) |

(52) U.S. Cl.

CPC ..... *G03G 9/09392* (2013.01); *G03G 9/08* (2013.01); *G03G 9/087* (2013.01); *G03G 9/093* (2013.01); *G03G 9/09307* (2013.01); *G03G 9/09321* (2013.01); *G03G 9/09364* (2013.01); *G03G 9/09378* (2013.01); *G03G 9/09385* (2013.01)

(58) Field of Classification Search

CPC ..... G03G 9/08; G03G 9/087
USPC ..... 430/45.53, 105, 110.1, 110.2, 110.3
See application file for complete search history.

(56) References Cited

U.S. PATENT DOCUMENTS

| | | | | |
|---|---|---|---|---|
| 4,340,660 | A * | 7/1982 | Kiuchi et al. | 430/108.22 |
| 8,697,323 | B2 * | 4/2014 | Kmiecik-Lawrynowicz et al. | 430/108.3 |
| 2007/0048643 | A1 * | 3/2007 | Kmiecik-Lawrynowicz et al. | 430/108.6 |
| 2008/0014525 | A1 * | 1/2008 | Sanders et al. | 430/113 |
| 2008/0063966 | A1 * | 3/2008 | Mattison et al. | 430/108.7 |
| 2008/0153017 | A1 * | 6/2008 | Park et al. | 430/48 |
| 2008/0299475 | A1 * | 12/2008 | Kidokoro | 430/108.4 |
| 2010/0015421 | A1 * | 1/2010 | Tyagi et al. | 428/207 |

* cited by examiner

*Primary Examiner* — Stewart Fraser
*Assistant Examiner* — Rachel Zhang
(74) *Attorney, Agent, or Firm* — MDIP LLC

(57) ABSTRACT

The present disclosure describes processes for making clear, high-gloss toners, including toner compositions resulting from such processes that find applications in overcoating and gloss enhancement.

9 Claims, No Drawings

CLEAR STYRENE EMULSION/AGGREGATION TONER

FIELD

The instant disclosure relates generally to a process of making toner compositions, such as, high gloss clear toners.

BACKGROUND

Toner resins with suitable melt viscosity produce images with high gloss on plain paper, for example, from about 25 to about 60 gloss units, see, for example, U.S. Pat. Nos. 5,612,777; 7,301,675; and 7,304,770. Toners which generate high gloss images often are selected for process color applications and transparencies. The fixing or fusing temperature of such toners can be high and can be more than 160° C. That results in high power consumption, low fixing speeds and reduced life of the fuser roll and fuser roll bearings. Hot and cold offsetting also can be a problem. Also, a number of toner resins having lower melt temperatures have narrow fusing latitude and have poor mechanical properties, such as, creating too many fines during jetting, which can result in increased cost of toner.

There is a need for a high gloss toner resin and toner thereof, which has a fix temperature below 160° C. (referred to as low fix temperature toner resin or low melt toner resin), excellent cold and hot offset performance, wide gloss latitude and processes for the preparation of such a resin. Toners which operate at lower temperatures would reduce the power needed for imaging device operation and increase the life of the fuser roll and the high temperature fuser roll bearings. High gloss toners with a wide fusing and excellent gloss latitude and with good toner particle elasticity are needed. Further, toners with wide fusing and excellent gloss latitude can provide flexibility in the amount of oil needed as release agent, can minimize copy quality deterioration related to the toner offsetting to the fuser roll and can extend fuser roll life.

Some of the needs have been met by the development of low molecular weight latex resins (see, e.g., U.S. Pat. No. 7,524,602, herein incorporated by reference in its entirety). However, there remains a need to develop a toner for overcoating and gloss enhancement applications that may be achieved more effectively with a clear toner.

Those and other advantages were achieved with the toners and processes of the present disclosure.

SUMMARY

The present disclosure describes processes for making clear toners, including toner compositions resulting from such processes. The toners as described in the present disclosure find applications in overcoating and gloss enhancement, which composition may be optimized for flow, toner mass area (TMA) and print performance.

In embodiments, a method of producing a clear toner is disclosed including mixing and homogenizing at high shear a first composition comprising a low molecular weight (LMW) latex resin and a low melt wax, where the LMW resin has a weight average molecular weight of from about $12\times10^3$ to about $45\times10^3$; mixing and heating the first composition until a desired particle size is achieved; contacting the first composition with a second composition to form a shell around the particles, where the second composition has a higher $T_g$ than that the first composition; mixing and heating the resulting aggregate mixture until a desired particle size and/or circularity is achieved; and washing and drying the cooled mixture to form dry toner particles, where when the dried toner particles are incorporated into a developer, that developer has a gloss value of between about 80 and 100 ggu.

In embodiments, a high gloss clear toner is described, where the toner is combined with an image element to form a protective coat over the surface of an image layer or where the toner is combined with an image element to enhance the gloss of an image layer.

In embodiments, a clear toner particle is disclosed including a low molecular weight (LMW) latex resin, low melt wax, and a polymer shell, where the LMW latex resin has a weight average molecular weight of from about $12\times10^3$ to about $45\times10^3$, where the toner particles exhibit an melt flow index (MFI) of between about 60 to 170 g/10 min, and when incorporated in a developer, the developer has a gloss value of between about 80 and 100 ggu.

DETAILED DESCRIPTION

The present disclosure describes processes for making clear toners, including clear, high gloss toner compositions that may be used in overcoating and gloss enhancement applications and/or applications which require optimized parameters with respect to flow, TMA and print performance.

In embodiments, a method of producing a clear toner is disclosed including:

- mixing and homogenizing at high shear a first composition containing a low molecular weight (LMW) latex resin with a low glass transition ($T_g$) temperature (LGTT) and a low melt wax, where the LMW, LGGT resin has a weight average molecular weight of from about $12\times10^3$ to about $45\times10^3$ and a Tg from about 45° C. to about 55° C.;
- mixing and heating the first composition until particles of a desired or select size are achieved;
- contacting the first composition with a second composition to form a shell around the particles, where the second composition has a higher $T_g$ than that of the first composition;
- mixing and heating the composition until particles of a desired or select size and/or shape, such as, circularity, are obtained; and
- washing and drying the mixture to form dry toner particles, where when the dry toner particles are incorporated in a developer, that developer has a gloss value of between about 80 and 100 ggu.

In the present disclosure, use of the singular includes the plural unless specifically stated otherwise. In the present disclosure, use of, "or," means, "and/or," unless stated otherwise. Furthermore, use of the term, "including," as well as other forms, such as, "includes," and, "included," is not limiting.

In the disclosure, by stating that a particular, predetermined or desired size of a particle is achieved or obtained is meant that on sampling, a majority, that is, 50% or more, of the particles satisfy the selection criterion or criteria.

By, "high shear," is meant a process wherein a toner particle mixture is homogenized by forces ample to form a preparation that is generally uniform in particle size, that is, unimodal, and of a suitable small size prior to aggregation in an emulsion aggregation process.

By, "clear toner," is meant a toner lacking a colorant, such as, a pigment or a dye, so that on applying to and processing on a receiving surface, such as, a paper, no color is imparted by the clear toner on the receiving surface.

For the purposes of the instant disclosure, "toner," "developer," "toner composition," and "toner particles," can be used interchangeably, and any particular or specific use and meaning will be evident from the context of the sentence, paragraph and the like in which the word or phrase appears. In one aspect, a toner is a powdery ink used dry to produce a photocopy.

As used herein, the modifier, "about," used in connection with a quantity is inclusive of the stated value and has the meaning dictated by the context (for example, it includes at least the degree of error associated with the measurement of the particular quantity). When used in the context of a range, the modifier, "about," should also be considered as disclosing the range defined by the absolute values of the two endpoints. For example, the range, "from about 2 to about 4," also discloses the range, "from 2 to 4." Equivalent terms include, "essentially" and "substantially."

Low Molecular Weight Latex Resin

In embodiments, a toner particle is disclosed including a low molecular weight (LMW) latex resin, low melt wax and a polymer shell, where the LMW latex resin has a weight average molecular weight of from about $12\times10^3$ to about $45\times10^3$, in embodiments, $15\times10^3$ to about $40\times10^3$, in embodiments, $20\times10^3$ to about $35\times10^3$, in embodiments, $25\times10^3$ to about $30\times10^3$.

In embodiments, the LMW latex resin may comprise a first and a second monomer composition. Any suitable monomer or mixture of monomers may be selected to prepare the first monomer composition and the second monomer composition. The selection of monomer or mixture of monomers for the first monomer composition is independent of that for the second monomer composition, and vise versa.

Exemplary monomers for the first and/or the second monomer compositions include, but are not limited to, a styrene, an acrylate, such as, an alkyl acrylate, such as, methyl acrylate, ethyl acrylate, butyl arylate, isobutyl acrylate, dodecyl acrylate, n-octyl acrylate, n-butylacrylate and 2-chloroethyl acrylate; β-carboxy ethyl acrylate (β-CEA), phenyl acrylate, methyl α-chloroacrylate, methyl methacrylate, ethyl methacrylate, butyl methacrylate, butadiene, isoprene, methacrylonitrile, acrylonitrile, vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone, methyl isopropenyl ketone and the like; vinylidene halides, such as, vinylidene chloride, vinylidene chlorofluoride and the like; N-vinyl indole, N-vinyl pyrrolidone, methacrylate, acrylic acid, methacrylic acid, acrylamide, methacrylamide, vinylpyridine, vinylpyrrolidone, vinyl-N-methylpyridinium chloride, vinyl naphthalene, p-chlorostyrene, vinyl chloride, vinyl bromide, vinyl fluoride, ethylene, propylene, butylene, isobutylene and mixtures thereof. A mixture of monomers can be a copolymer, such as, a block copolymer, an alternating copolymer, a graft copolymer and so on.

In some embodiments, the first monomer composition and the second monomer composition may independently of each other comprise two or three or more different monomers. The latex polymer therefore can comprise a copolymer. Illustrative examples of such latex copolymers include poly(styrene-n-butyl acrylate-(β-CEA), poly(styrene-alkyl acrylate), poly (styrene-1,3-diene), poly(styrene-1,2-diene), poly(styrene-1,4-diene), poly(styrene-alkyl methacrylate), poly(alkyl methacrylate-alkyl acrylate), poly(alkyl methacrylate-aryl acrylate), poly(aryl methacrylate-alkyl acrylate), poly(alkyl methacrylate), poly(styrene-alkyl acrylate-acrylonitrile), poly(styrene-1,3-diene-acrylonitrile), poly(alkyl acrylate-acrylonitrile), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylonitrile), poly(styrene-butyl acrylate-acrylonitrile) and the like.

In embodiments, the first monomer composition and the second monomer composition may be substantially water insoluble, generally hydrophobic and may be dispersed readily in the aqueous phase with adequate stirring when added to the reaction vessel.

The weight ratio between the first monomer composition and the second monomer composition may be generally in the range of from about 0.1:99.9 to about 50:50, from about 0.5:99.5 to about 25:75, from about 1:99 to about 10:90.

In embodiments, the first monomer composition and the second monomer composition are the same.

An example of a composition for making a latex may be one comprising a styrene and an alkyl acrylate, such as, a mixture comprising styrene, n-butyl acrylate and β-carboxyethyl acrylate (β-CEA). Based on total weight of the monomers, styrene generally may be present in an amount from about 1% to about 99%, from about 50% to about 95%, from about 70% to about 90%, although may be present in greater or lesser amounts; alkyl acrylate, such as, n-butyl acrylate, generally may be present in an amount from about 1% to about 99%, from about 5% to about 50%, from about 10% to about 30%, although may be present in greater or lesser amounts.

A surfactant may be used in the reaction. Any suitable surfactants may be used for the preparation of latex and wax dispersions according to the present disclosure. Depending on the emulsion system, any desired nonionic or ionic surfactant, such as, an anionic or a cationic surfactant, may be contemplated.

Examples of suitable anionic surfactants include, but are not limited to, sodium dodecylsulfate, sodium dodecylbenzene sulfonate, sodium dodecylnaphthalenesulfate, dialkyl benzenealkyl sulfates and sulfonates, abitic acid, NEOGEN R® and NEOGEN SC® available from Kao, Tayca Power®, available from Tayca Corp., DOWFAX®, available from Dow Chemical Co., and the like, as well as mixtures thereof.

Examples of suitable cationic surfactants include, but are not limited to, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$ and $C_{17}$ trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride, available from Kao Chemicals) and the like, as well as mixtures thereof.

Examples of suitable nonionic surfactants include, but are not limited to, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy)ethanols (available from Rhone-Poulenc as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890® and ANTAROX 897® and the like, as well as mixtures thereof.

Surfactants may be employed in any desired or effective amount, generally, at least about 0.01% by weight of total monomers used to prepare the latex polymer, at least about 0.1% by weight of total monomers used to prepare the latex polymer, or, no more than about 10% by weight of total monomers used to prepare the latex polymer, no more than about 5% by weight of total monomers used to prepare the latex polymer, although the amount can be outside of those ranges.

Any suitable initiator or mixture of initiators, if and as needed, may be selected in the latex process and the toner process according to the present disclosure. In typical embodiments, the initiator is selected from various known free radical polymerization initiators. The free radical initiator can be any free radical polymerization initiator capable of initiating a free radical polymerization process and mixtures thereof, typically free radical initiators capable of providing free radical species on heating to above about 30° C.

Although water soluble free radical initiators that are traditionally used in emulsion polymerization reactions are typically selected, it also is within the scope of the present disclosure that other free radical initiators can be employed. Examples of suitable free radical initiators include, but are not limited to, persulfates, such as, ammonium persulfate and potassium persulfate, peroxides, such as, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, tetralin hydroperoxide, 1-phenyl-2-methylpropyl-1-hydroperoxide and tert-butylhydroperoxide pertriphenylacetate, diisopropyl peroxycarbonate, tert-butyl performate, tert-butyl peracetate, tert-butyl perbenzoate, tert-butyl perphenylacetate, tert-butyl permethoxyacetate, tert-butyl per-N-(3-toluoyl)carbamate, sodium persulfate, potassium persulfate, azo compounds, such as, 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)-nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalono-dinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1'-azobis-1,2-diphenylethane, poly(bisphenol A-4,4'-azobis-4-cyanopentano-ate, and poly(tetraethylene glycol-2,2'-azobisisobutyrate); 1,4-bis(pentaethylene)-2-tetrazene, 1,4-dimethoxycarbonyl-1,4-dipheny-1-2-tetrazene and the like; and mixtures thereof.

Other free radical initiators include, but are not limited to, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate and the like.

Based on total weight of the monomers to be polymerized, the initiator generally may be present in an amount from about 0.1% to about 5%, from about 0.4% to about 4%, from about 0.5% to about 3%, although may be present in greater or lesser amounts.

A chain transfer agent optionally may be used to control the polymerization degree of the latex, and thereby control the molecular weight and molecular weight distribution of the product. A chain transfer agent may become part of the latex polymer.

In embodiments, the chain transfer agent has a carbon-sulfur covalent bond. The carbon-sulfur covalent bond can have an absorption peak ranging from about 500 to about 800 $cm^{-1}$ in an infrared absorption spectrum. When a chain transfer agent is incorporated into a latex, and a toner made from such a latex, the absorption peak may be changed, for example, from about 400 to about 4,000 $cm^{-1}$.

Exemplary chain transfer agents include, but are not limited to, n-$C_{3-15}$ alkylmercaptans, such as, n-propylmercaptan, n-butylmercaptan, n-amylmercaptan, n-hexylmercaptan, n-heptylmercaptan, n-octylmercaptan, n-nonylmercaptan, n-decylmercaptan and n-dodecylmercaptan; branched alkylmercaptans, such as, isopropylmercaptan, isobutylmercaptan, s-butylmercaptan, tert-butylmercaptan, cyclohexylmercaptan, tert-hexadecylmercaptan, tert-laurylmercaptan, tert-nonylmercaptan, tert-octylmercaptan and tert-tetradecylmercaptan; aromatic ring-containing mercaptans, such as, allylmercaptan, 3-phenylpropylmercaptan, phenylmercaptan, and mercaptotriphenylmethane; and the like. As a skilled artisan understands, the term -mercaptan and -thiol may be used interchangeably to mean a C—SH group.

Typical examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide and the like.

Based on total weight of the monomers to be polymerized, the chain transfer agent may generally be present in an amount from about 0.1% to about 7%, from about 0.5% to about 6%, from about 1.0% to about 5%, although may be present in greater or lesser amounts.

In various embodiments, a branching agent optionally may be included in the composition to control the branching structure of the target latex. Exemplary branching agents include, but are not limited to, decanediol diacrylate (ADOD), trimethylolpropane, pentaerythritol, trimellitic acid, pyromellitic acid and mixtures thereof.

Based on total weight of the monomers to be polymerized, the branching agent generally may be present in an amount from about 0.01% to about 2%, from about 0.05% to about 1.0%, from about 0.1% to about 0.8%, although greater or lesser amounts may be used.

Methods of producing such LMW latex resins may be carried out as described in the disclosure of U.S. Pat. No. 7,524,602, herein incorporated by reference in entirety.

The present disclosure also provides a melt mixing process to produce low cost and safe cross linked thermoplastic binder resins for toner compositions with high gloss. In the process, LMW resins or polymers are melt blended, that is, in the molten state under high shear conditions producing substantially uniformly dispersed toner constituents, and which process provides a resin blend and toner product with optimized gloss properties (see, e.g., U.S. Pat. No. 5,556,732, herein incorporated by reference in entirety). By cross linked is meant that the polymer involved is substantially cross linked, that is, for example, equal to or above the gel point thereof. As used herein, "gel point" means the point where the polymer is no longer soluble in solution (see, e.g., U.S. Pat. No. 4,457,998, herein incorporated by reference in entirety).

Any type of reactor suitably may be used without restriction. The reactor generally includes means for stirring the composition therein. Typically, the reactor includes at least one impeller. For forming the latex and/or toner, the reactor preferably is operated throughout the process such that the impellers can operate at an effective mixing rate of about 10 to about 1,000 rpm.

Following completion of the monomer addition, the latex may be permitted to stabilize by maintaining the conditions for a period of time, for example, for about 10 to about 300 minutes, before cooling. Optionally, the latex may be isolated by standard methods known in the art, for example, coagulation, dissolution and precipitation, filtration, washing, drying or the like.

The $T_g$ of the core resin can be about 80° C. or less, about 60° C. or less, about 40° C. or less.

Based on the total particle weight, the latex having weight average molecular weight of from about $12\times10^3$ to about $45\times10^3$ may be present in an amount from about 50% to about 99%, from about 60% to about 98%, from about 70% to about 95%, although the latex may be present in greater or lesser amounts.

Emulsification may be done by any suitable process such as mixing at elevated temperature. For example, the emulsion mixture may be mixed in a homogenizer set at about 200 to about 400 rpm and at a temperature of from about 40° C. to about 80° C. for a period of from about 1 minute to about 20 minutes.

Wax

In addition to the polymer resin, the particles of the present disclosure also contain a wax, which can be either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

The wax may be present in an amount of, for example, from about 1 weight % to about 25 weight % of the toner particles, in embodiments, from about 5 weight % to about 20 weight % of the toner particles.

Waxes that may be selected include waxes having, for example, a weight average molecular weight of from about 500 to about 20,000, in embodiments from about 1,000 to about 10,000. Waxes for preparing the core of interest have a low melting point, such as, less than about 90° C., less than about 85° C., less than about 75° C., less than about 65° C., less than about 55° C., a low melt wax.

Waxes that may be used include, for example, polyolefins, such as, polyethylene, polypropylene and polybutene waxes, such as, commercially available from Allied Chemical and Petrolite Corporation, for example, POLYWAX™ polyethylene waxes from Baker Petrolite, wax emulsions available from Michaelman, Inc. and Daniels Products Company, EPOLENE N-15™ commercially available from Eastman Chemical Products, Inc., VISCOL 550-P™, a low weight average molecular weight polypropylene available from Sanyo Kasei K. K.; plant-based waxes, such as carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax and Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate and pentaerythritol tetra behenate; ester waxes obtained from higher fatty acid and multivalent alcohol multimers, such as, diethyleneglycol monostearate, dipropyleneglycol distearate, diglyceryl distearate and triglyceryl tetrastearate; sorbitan higher fatty acid ester waxes, such as, sorbitan monostearate and cholesterol higher fatty acid ester waxes, such as, cholesteryl stearate. Examples of functionalized waxes that may be used include, for example, amines, amides, for example, AQUA SUPERSLIP6550™ and SUPERSLIP6530™ available from Micro Powder Inc., fluorinated waxes, for example, POLYFLUO190™, POLYFLUO 200™, POLYSILK 19™ and POLYSILK 14™ available from Micro Powder Inc., mixed fluorinated, amide waxes, for example, MICROSPERSION19™ also available from Micro Powder Inc., imides, esters, quaternary amines, carboxylic acids or acrylic polymer emulsions, for example, JONCRYL 74™, 89™, 130™, 537™ and 538™, all available from SC Johnson Wax, and chlorinated polypropylenes and polyethylenes available from Allied Chemical, Petrolite Corporation and SC Johnson wax. Mixtures and combinations of the foregoing waxes also may be used in embodiments.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology, see, for example, U.S. Pat. No. 7,829,253. Hence, a latex of interest having a weight average molecular weight of from about $12\times10^3$ to about $45\times10^3$ may be used for emulsion/aggregation processes for forming toners and developers by known methods.

In embodiments, toner compositions may be prepared by emulsion-aggregation processes, such as, a process that includes forming particles in an emulsion or emulsifying resin particles in an aqueous medium, aggregating a mixture of a low melting point wax and any other desired or required additives, and emulsions including the resins described above, optionally, with surfactants as described above, and then coalescing the aggregate mixture. A mixture may be prepared by adding an optional other wax or other materials, which also may be optionally in a dispersion(s) including a surfactant, to the emulsion, which may be a mixture of two or more emulsions containing the resin. The pH of the resulting mixture may be adjusted by a base or an acid (i.e., a pH adjustor) such as, for example, acetic acid, nitric acid or the like, and for example, sodium hydroxide, potassium hydroxide, ammonium hydroxide and the like. In embodiments, the pH of the mixture may be adjusted to about 4.5, to about 7.

Raising the pH can terminate the polymerization reaction and/or particle growth. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

The latex of interest having a weight average molecular weight of from about $12\times10^3$ to about $45\times10^3$ may be melt-blended or otherwise mixed with various optional toner ingredients, such as, a wax dispersion, a coagulant, a silica, a charge enhancing additive, charge control additive, a surfactant, an emulsifier, a flow additive and the like. Optionally, the latex (e.g. about 40% solids) may be diluted to a solids loading of about 12 to 15% by weight solids before formulated into a toner composition.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides, such as, polyaluminum chloride (PAC), or the corresponding bromide, fluoride or iodide, polyaluminum silicates, such as, polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, zinc acetate dehydrate, magnesium acetate, magnesium nitrate, magnesium sulfate, zinc acetate, aluminum chloride, zinc nitrate, zinc sulfate, zinc chloride, zinc bromide, magnesium bromide, copper chloride, copper sulfate and combinations thereof. In embodiments, the aggregating agent may be added to the mixture at a temperature that is below the $T_g$ of the resin.

The aggregating agent may be added to the mixture in an amount of, for example, from about 0.1 parts per hundred (pph) to about 1 pph, in embodiments, from about 0.25 pph to about 0.75 pph.

The gloss of a toner may be influenced by the amount of retained metal ion, such as $Al^{3+}$, in the particle. The amount of retained metal ion may be adjusted further by the addition of a chelator, such as, EDTA. In embodiments, the amount of retained metal ion, for example $Al^{3+}$, in toner particles of the present disclosure may be from about 0.1 pph to about 1 pph, from about 0.25 pph to about 0.8 pph, in embodiments, about 0.5 pph.

To control aggregation and coalescence of the particles, in embodiments, the aggregating agent, acid or base may be metered into the mixture over time. For example, the agent, acid or base may be metered into the mixture over a period of from about 5 to about 240 minutes, in embodiments from about 30 to about 200 minutes. The addition of the agent, acid or base also may be executed while the mixture is maintained under stirred conditions, in embodiments, from about 50 rpm to about 1,000 rpm, in embodiments, from about 100 rpm to about 500 rpm, and at a temperature that is below the $T_g$ of the core resin.

The particles may be permitted to aggregate until a predetermined desired or select particle size is obtained. A predetermined desired size refers to the desired particle size to be obtained as determined prior to formation, and the particle size being monitored during the growth process until such particle size is reached. Samples may be taken during the growth process and analyzed, for example, with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments, from about hour 1 to about 5 hours, while maintaining stirring, to provide the aggregated particles.

Once the predetermined desired or select particle size is reached, a shell resin or polymer is introduced into the reaction mixture. In embodiments, the predetermined desired or select particle size is from about 4 to about 9 μm, from about 5 to about 8 μm, about 6.5 to about 7.5 μm prior to shell formation.

Shell Resin

In embodiments, a shell is applied to the formed aggregated toner particles. Any resin described above as suitable for use as a core resin may be used as a shell resin so long as the $T_g$ thereof is higher than the $T_g$ of the core resin. In embodiments, the $T_g$ of a shell resin is more than about 2° C. higher than the $T_g$ of a core resin, more than about 3° C. higher, more than about 4° C. higher, or higher. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, an amorphous polyester may be used to form a shell over the aggregates to form toner particles having a core-shell configuration.

A suitable or select size of the core-shell particle is from about 6 to about 8 μm, from about 6.5 to about 7.5 μm. The shell component may comprise about 20 to about 30% by weight of the toner particles.

In embodiments, an initiator may be included in the shell-forming mixture. The initiator may be a photoinitiator. The initiator may be present in an amount of from about 1% to about 5% by weight of the toner reagents, from about 2% to about 4% by weight of the reagents.

Once the desired final size of the toner particles is achieved, from about 6 to about 8 μm, from about 6.5 to about 7.5 μm, the pH of the mixture may be adjusted with a base (i.e., a pH adjustor) to a value of from about 6 to about 10, in embodiments from about 6 to about 7. The adjustment of the pH may freeze, that is to stop, particle growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA), sodium citrate, dimethoxysulfoxide, methyglycine diacetic acid, zeolites compounds or other known chelators may be used to adjust the pH to the desired values noted above. The base may be added in amounts from about 2 to about 25% by weight of the mixture, in embodiments, from about 4 to about 10% by weight of the mixture. In embodiments, the shell resin has a higher $T_g$ than the core resin.

Coalescence

Following aggregation to the desired particle size, with the formation of a shell as described above, the particles then may be coalesced to the desired final shape, the coalescence being achieved by, for example, heating the mixture to a temperature of from about 55° C. to about 100° C., in embodiments, from about 65° C. to about 75° C., which may be below the melting point of the crystalline resin to prevent plasticization. Higher or lower temperatures may be used, it being understood that the temperature is a function of the resins used in the particles.

Coalescence may proceed and be accomplished over a period of from about 0.1 to about 9 hours, in embodiments, from about 0.5 to about 4 hours.

After coalescence, the mixture may be cooled to room temperature, such as, from about 20° C. to about 25° C. The cooling may be rapid or slow, as desired. A suitable cooling method may include introducing cold water to a jacket around the reactor. After cooling, the toner particles may be optionally washed with water and then dried. Drying may be accomplished by any suitable method for drying including, for example, freeze-drying.

Generally, desirable particles are essentially smooth. Generally, desirable particles are essentially circular or ovoid. For example, particles of interest can have a circularity ratio of at least about 0.96, at least about 0.97, at least about 0.98. Generally, the particles have, for the longest dimension, a length of about 6 μm, at least about 6.5 μm, at least about 7 μm Additives In embodiments, the toner particles also may contain other optional additives, as desired or required. For example, the toner may include any known charge additives in amounts of from about 0.1 to about 10 wt %, in embodiments, from about 0.5 to about 7 wt % of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in entirety, negative charge enhancing additives like aluminum complexes and the like.

Surface additives can be added to the toner compositions of the present disclosure after washing or drying. Examples of such surface additives include, for example, metal salts, metal salts of fatty acids, colloidal silicas, metal oxides, strontium titanates, mixtures thereof and the like. Surface additives may be present in an amount of from about 0.1 to about 10 wt %, in embodiments, from about 0.5 to about 7 wt % of the toner. Examples of such additives include those disclosed in U.S. Pat. Nos. 3,590,000, 3,720,617, 3,655,374 and 3,983,045, the disclosures of each of which are hereby incorporated by reference in entirety. Other additives include zinc stearate and AEROSIL R972® available from Degussa. The coated silicas of U.S. Pat. Nos. 6,190,815 and 6,004,714, the disclosures of each of which are hereby incorporated by reference in entirety, can also be present in an amount of from about 0.05 to about 5%, in embodiments of from about 0.1 to about 2% of the toner, which additives can be added during the aggregation or blended into the formed toner product.

The characteristics of the toner particles may be determined by any suitable technique and apparatus. Volume average particle diameter $D_{50v}$, geometric standard deviation (GSD) $GSD_v$ and $GSD_n$ may be measured by means of a suitable measuring instrument, such as, a Beckman Coulter Multisizer 3, operated in accordance with the manufacturer's instructions. Representative sampling may occur as follows: a small amount of toner sample, about 1 gram, may be obtained and filtered through a 25 μm screen, then put in isotonic solution to obtain a concentration of about 10%, with the sample then run in a Beckman Coulter Multisizer 3. Toners produced in accordance with the present disclosure may be generally about 7 μm in diameter and generally smooth.

Using the methods of the present disclosure, desirable gloss levels may be obtained. Thus, for example, the gloss level of a toner of the present disclosure may have a gloss as measured by Gardner Gloss Units (ggu) of from about 20 ggu to about 100 ggu, in embodiments, from about 50 ggu to about 95 ggu, in embodiments from about 60 ggu to about 90 ggu, from about 80 to about 100 ggu.

In embodiments, toners of the present disclosure may be used as ultra low melt (ULM) toners. In embodiments, the dry toner particles, exclusive of external surface additives, may have the following characteristics:

(1) circularity ratio of from about 0.9 to about 1 (measured with, for example, a Sysmex 3000 analyzer), in embodiments, from about 0.95 to about 0.99, from about 0.96 to about 0.98;

(2) core-shell structure where the $T_g$ of the shell resin is higher than that of the core resin; and (3) a melt flow index (MFI) (5 kg/130° C.) of from about 50 to about 180 g/10 min, from 60 to about 170 g/10 min, from 70 to about 160 g/10 min.

Developers

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments, from about 2% to about 15% by weight of the total weight of the developer.

Various other known compounds can be added to and mixed with the resin particles to construct a developer, as known in the art, such as, a silica, a titania and so on.

Imaging

The toners and developers can be used for electrophotographic processes, including those disclosed in U.S. Pat. No. 4,295,990, the disclosure of which is hereby incorporated by reference in entirety. In embodiments, any known type of image development system may be used in an image developing device, including, for example, magnetic brush development, jumping single-component development, hybrid scavengeless development (HSD) and the like.

It is envisioned that the toners of the present disclosure may be used in any suitable procedure for assisting in forming or enhancing an image with toner, including applications other than xerographic applications.

Using the toners of the present disclosure, images may be formed on substrates, including flexible substrates, having a toner pile height of from about 1 μm to about 6 μm, from about 2 μm to about 4.5 μm, from about 2.5 to about 4.2 μm.

In embodiments, the toner of the present disclosure may be used as a xerographic print protective composition that provides overprint coating properties including, but not limited to, thermal and light stability and smear resistance, as in commercial print applications. More specifically, such overprint coating as envisioned has the ability to permit overwriting, reduce or prevent thermal cracking, improve fusing, reduce or prevent document offset, improve print performance and protect an image from sun, heat and the like. In other embodiments, the overprint compositions may be used to improve the overall appearance of xerographic prints due to the ability of the compositions to fill in the roughness of xerographic substrates and toners, thereby forming a level film and enhancing glossiness.

The following Examples are being submitted to illustrate embodiments of the present disclosure. The Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Clear Toner Formulation

The formulation is as follows:

55 parts of deionized water;

27 parts low molecular weight (LMW) styrene/n-butylacrylate/carboxyethylacrylate emulsion latex resin;

5 parts low melt paraffin wax with a melting point of 75.5° C.±5.5° C.; and 0.2 parts polyaluminum chloride.

The formulation above was charged into a reactor (e.g., a Henschel blender) and homogenized with high sheer at 4000 rpm for 20 minutes. The resulting mixture then was mixed at 350 rpm with a 4" impeller at a 45° angle, 1-2" off the reactor bottom while heating to 55-60° C. The mixture then was heated until a particle size of about 5-8 μm, with a target size of 7 μm is achieved, then a higher $T_g$ shell polymer of styrene/n-butylacrylate/carboxyethylacrylate (12 parts) was added to the reaction mixture. Once grown to the appropriate size (i.e., about 6.5 to about 7.5 μm), 3 parts of an EDTA solution were added to the aggregate, then NaOH was added to increase the pH to 7.0 to freeze particle size. Once frozen, the aggregated mixture temperature was increased to 96° C. for a period of two hours or until the appropriate circularity was achieved (e.g., about 0.965 to about 0.980, as measured by the Sysmex 3000). Once the desired circularity was reached, the mixture was cooled to about 60-65° C., and NaOH again was added to adjust the pH to about 9 and the mixture cooled further. Once cooled, the product was sieved, washed and dried to produce dry toner particles. The particles then were blended with silica and organic spacers to produce a developer. The developer then was placed into a cartridge and used to print documents in a single component development (SCD) machine.

Results

Four different clear, high gloss toners were produced varying the amount of chelator and the amount of wax. The particles were approximately 7 μm in size, were generally potato-shaped and were generally smooth. The particles then were blended into a developer and tested for performance and printing characteristics. Melt flow index was calculated as known in the art (Tinius Olsen device at 130° C./5 kg), the amount of crosslinking was inferred by examining the amount of aluminum in the toner and a gloss meter was employed at 75° on plain paper.

TABLE 1

Table of Particle Design of Experiment and Melt Flow Index Results

| Toner/Particle | Type | Melt Flow Index (MFI) g/10 min (5 kg/130° C.) |
|---|---|---|
| High Gloss Clear 1 | Low release, low cross linking | 79.1 |
| High Gloss Clear 2 | Low release, high cross linking | 64.4 |
| High Gloss Clear 3 | High release, high cross linking | 120.4 |
| High Gloss Clear 4 | High release, low cross linking | 172.3 |
| Conventional Polyester control | High gloss conventional polyester | 96.4 |

Clear particles 1-4 had gloss values of between 80 and 95 ggu. Clear particle 2 showed the best gloss on plain paper. Melt flow indices of about 60 to about 170 gm/10 min were possible by controlling the degree of cross linking and wax levels. Higher MFI levels may create too much flow for plain paper, creating a lower gloss by over-penetration of the paper.

It will be appreciated that several of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims.

Unless specifically recited in a claim, steps or components of claims should not be implied or imported from the specification or any other claims as to any particular order, number, position, size, shape, angle, color or material.

All references cited herein are herein incorporated by reference in their entireties.

We claim:

1. A single component developer comprising clear, low melt toner particles lacking a colorant produced by a process comprising:

a) mixing and homogenizing a first composition comprising a low molecular weight (LMW) latex resin, an aggregating agent and a low melt wax in the absence of a colorant, wherein the LMW resin has a weight average molecular weight of from about $12\times10^3$ to about $45\times10^3$;

b) mixing and heating the first composition until core particles are obtained;

c) contacting the first composition with a second composition in the absence of a colorant to form a shell around said core particles, wherein said second composition has a $T_g$ higher than that of said first composition to yield core-shell particles;

d) coalescing said core-shell particles to produce said clear, low melt toner particles; and f) collecting said clear, low melt toner particles;

wherein said clear, low melt toner particles lack colorant, comprise said low molecular weight (LMW) latex resin, said low melt wax and a polymer shell, wherein the polymer shell $T_g$ is higher than that of the LMW latex resin, comprise a gloss of between about 80 to 100 ggu, and a melt flow index (5 kg/130° C.) of from about 70 to about 160 g/10 min.

2. Single component developer comprising clear, low melt toner particles lacking a colorant comprising a low molecular weight (LMW) latex resin, a low melt wax and a polymer shell, wherein the LMW latex resin has a weight average molecular weight of from about $12\times10^3$ to about $45\times10^3$; and the polymer shell $T_g$ is higher than that of the LMW latex resin, wherein said toner particles have gloss value of from about 80 to about 100 ggu, and a melt flow index (5 kg/130° C.) of between about 60 to about 170 g/10 min.

3. The developer of claim 2, wherein the LMW latex resin comprises at least one monomer selected from the group consistina, of styrene, methyl acrylate, ethyl acrylate, butyl acrylate, isobutyl acrylate, dodecyl acrylate, n-octyl acrylate, 2-chloroethyl acrylate, β-carboxyethyl acrylate (β-CEA), phenyl acrylate, methyl α-ehloroacrylate, methyl methacrylate, ethyl methacrylate, n-butylacrylate, butyl methacrylate, butadiene, isoprene, methacrylonitrile, acrylonitrile, vinyl methyl ether, vinyl isobutyl ether, vinyl ethyl ether, vinyl acetate, vinyl propionate, vinyl benzoate, vinyl butyrate, vinyl methyl ketone, vinyl hexyl ketone, methyl isopropenyl ketone, vinylidene chloride, vinytidene chlorofluoride, N-vinyl indole, N-vinyl pyrrolidone, methacrylate, acrylic acid, methacrylic acid, acrylamide, methacrylamide, vinylpyridine, vinylpyrrolidone, vinyl-N-methylpyridinium chloride, vinyl naphthalene, p-chlorostyrene, vinyl chloride, vinyl bromide, vinyl fluoride, ethylene, propylene, butylene, isobutylene, and combinations thereof.

4. The developer of claim 2, wherein said toner particles are of a size from about 5 μm to about 8 μm.

5. The developer of claim 2, wherein said particles have a circularity ratio of about 0.96 to about 0.98.

6. The developer of claim 2, wherein the LMW latex resin comprises a first and second monomer.

7. The developer of claim 6, wherein said LMW latex resin comprises a styrene and an acrylate.

8. The developer of claim 2, wherein said LMW latex resin further comprises β-carboxyethylacrylate.

9. The developer of claim 2, wherein the low melt wax is selected from the group consisting of Fischer-Tropsch wax, carnauba wax, Japan wax, Bayberry wax, rice wax, sugar cane wax, candelilla wax, tallow, jojoba oil, beeswax, Shellac wax, Spermaceti wax, whale wax, Chinese wax, lanolin, ester wax, capronamide, caprylamide, pelargonic amide, capric amide, laurylamine, tridecanoic amide, myristylamide, stearamide, behenic amide, ethylene-bisstearamide, caproleic amide, myristoleic amide, oleamide, elaidic amide, linoleic amide, erucamide, ricinoleic amide, linolenic amide, montan wax, ozokerite, ceresin, lignite wax, paraffin wax, microcrystalline wax, low-molecular polyethylene, low-molecular polypropylene, low-molecular polybutene, polytetrafluoroethylene wax, Akura wax, distearyl ketone, castor wax, opal wax, montan wax derivatives, paraffin wax derivatives, microcrystalline wax derivatives, and combinations thereof.

* * * * *